United States Patent [19]

Sutera

[11] 4,195,831

[45] Apr. 1, 1980

[54] SHEET LOADING DEVICE

[75] Inventor: Richard Sutera, Dayton, Ohio

[73] Assignee: The Mead Corporation, Dayton, Ohio

[21] Appl. No.: 942,688

[22] Filed: Sep. 15, 1978

[51] Int. Cl.[2] ..... B65H 29/58

[52] U.S. Cl. ..... 271/302 DAS; 271/276

[58] Field of Search ..... 271/10, 64, 196, 273, 271/275-277, 173

[56] References Cited

U.S. PATENT DOCUMENTS

| | | | |
|---|---|---|---|
| 3,284,081 | 11/1966 | Huck | 271/64 |
| 3,430,951 | 3/1969 | Hulka et al. | 271/64 |
| 3,724,657 | 4/1973 | Katagiri et al. | 271/64 X |
| 3,788,636 | 1/1974 | Rehm et al. | 271/4 |
| 3,856,132 | 12/1974 | Sakurai et al. | 198/30 |
| 3,941,375 | 3/1976 | White et al. | 271/251 |
| 3,973,767 | 8/1976 | Kramer | 271/12 |
| 4,006,894 | 2/1977 | Raible et al. | 271/173 |
| 4,010,883 | 3/1977 | Ritter | 226/171 |
| 4,030,607 | 6/1977 | Suda et al. | 271/64 X |
| 4,045,014 | 8/1977 | Karlsson | 271/275 X |

FOREIGN PATENT DOCUMENTS

| | | | |
|---|---|---|---|
| 1176675 | 8/1964 | Fed. Rep. of Germany | 271/276 |
| 2620138 | 11/1977 | Fed. Rep. of Germany | 271/276 |

*Primary Examiner*—Robert W. Saifer

*Attorney, Agent, or Firm*—Biebel, French & Nauman

[57] ABSTRACT

The sheet loading device for supplying a sheet of material from a sheet supply station to any of a plurality of sheet supporting rotatable drums includes an endless belt continuously moving past the sheet supply station and the rotatable drums. A rotatable belt deflecting roller is mounted adjacent each of the drums. A sheet supply arrangement urges a sheet at the supply station into engagement with the belt such that the sheet is carried by the belt toward the drums. One of the belt deflecting rollers is translated toward its respective sheet supporting drum such that the belt is deflected to wrap partially around the drum, whereby the sheet carried by the belt will be loaded onto the drum.

14 Claims, 4 Drawing Figures

16
14
42
44
46
86
80
78
31
10
12
66
64
62
58
60
68
88
50
48
46
90
74
72
70
76
17
34
22
32
20
82

SHEET LOADING DEVICE

BACKGROUND OF THE INVENTION

The present invention relates to a paper handling device for handling sheets of paper and for providing such sheets selectively to any of a plurality of paper supporting drums.

In printing and duplicating devices, such as for instance office copiers, sheets of material such as copy paper or the original documents to be copied must be delivered within the device to points at which to printing or scanning equipment. Typically, a sheet is mounted on a rotating drum and printing or scanning accomplished by a printing device or an optical scanner as the sheet is rotated on the drum.

One known technique for supplying a sheet of material to a drum is to transport the sheet via one or more moving endless belts. U.S. Pat. No. 3,856,132, issued Dec. 24, 1974, discloses a sheet coveying arrangement in a mail handling device, incorporating a rotating drum. The drum receives letters via pairs of belts which engage the letters therebetween.

When it is desired to cause sheets to be held on a rotating drum, a hollow drum has been used, having a drum cavity which is partially evacuated. The drum defines a plurality of openings in the drum periphery which communicate with the drum cavity. The sheet material is drawn toward the drum surface and held thereon by the partial vacuum within the drum, as shown in U.S. Pat. No. 3,788,636, issued Jan. 29, 1974, to Rehm et al.

The technique of delivering a sheet of paper or other material to a drum by a belt supply may be enhanced by causing the belt to wrap partially around the periphery of the drum and move at a speed equal to the tangential velocity of the drum. Such belt supply mechanisms are shown in U.S. Pat. No. 3,973,767, issued Aug. 10, 1976, to Kramer, and U.S. Pat. No. 3,941,375, issued Mar. 2, 1976, to White et al. Where the conveying belt is moved into and out of engagement with the rotating drum to provide a partial wrap around the drum periphery only on an intermittent basis, it is desirable that the belt remain in tension, even when it is not in contact with the drum. U.S. Pat. No. 4,010,883, issued Mar. 8, 1977, to Ritter, includes a spring loaded belt guide element which engages the belt and takes up the slack that would otherwise appear due to elimination of the wrap around the periphery of the drum.

None of the above prior art devices are capable of supplying sheets of material from a single sheet supply station to any of a plurality of rotating sheet supporting drums. Such a sheet supply arrangement is especially advantageous in a printer in which print images are to be formed by several printing units, each unit having its own associated drum. To provide plural sheet supply stations, one for each drum, would require substantial space and would further necessitate checking of each of the supply stations by the operator frequently to determine that the supply of sheets at each of the stations has not been depleted.

SUMMARY OF THE INVENTION

A sheet loading device for supplying a sheet of material from a sheet supply station to any of a plurality of sheet supporting rotatable drum means and positioning the sheet thereon includes a plurality of sheet supporting rotatable drum means for supporting the sheet of material on the exterior surfaces thereof. Each of the drum means defines a drum cavity and vacuum openings in the exterior surface communicating with the drum cavity. A suction means partially evacuates each of the drum cavities while a means for rotating each of the plurality of sheet supporting drum means rotates the drum means about substantially parallel rotational axii. A plurality of rotatable belt deflecting rollers are each mounted adjacent a respective one of the plurality of sheet supporting drum means. An endless belt passes between the plurality of belt deflecting rollers and the plurality of sheet supporting drum means and extend past the sheet supply station. A belt drive means continuously moves the belt past the belt deflecting rollers and the sheet supply station.

A sheet supply means at the sheet supply station urges a sheet of material into engagement with the belt such that the sheet is carried by the belt toward the plurality of sheet supporting drum means. A means is provided for selectively translating any of the plurality of belt deflecting rollers toward its respective sheet supporting drum means such that the belt is deflected to wrap partially around the respective sheet supporting drum means. The sheet carried by the belt will thereby be loaded onto the respective sheet supporting drum means and held on the exterior surface thereof by the partial vacuum in the drum cavity of the respective drum means.

The means for selectively translating any of the plurality of belt deflecting rollers may comprise a plurality of roller supporting means, each such roller supporting means mounting a respective pair of the plurality of belt deflecting rollers, and means for pivoting any of the roller supporting means about a point intermediate the pair of belt deflecting rollers. The roller supporting means may be pivoted either in a first direction such that the belt is deflected by one of the pair of rollers to wrap partially around the drum means associated with the roller or in a second direction such that the belt is deflected by the other of the pair of rollers to wrap partially around the drum means associated with that roller. Pivoting of one of the roller support means in a desired direction will thereby result in a sheet of material being mounted upon a selected one of the plurality of sheet supporting drum means.

Accordingly, it is an object of the present invention to provide a sheet loading device in which a sheet of material from a sheet supply station may be selectively supplied to any of a plurality of rotatable sheet supporting drums; to provide such a sheet loading device in which a sheet of material is carried by a belt toward the drums and deflected such that the belt will wrap partially around the one of the plurality of drums upon which the sheet is to be mounted; and, to provide such a sheet loading device in which pairs of belt deflecting rollers are mounted on roller supports which may be pivoted to cause one of the pair of rollers to deflect the belt.

DETAILED DESCRIPTION OF THE PREFERRED EMBODIMENTS

Figures 1, 2:
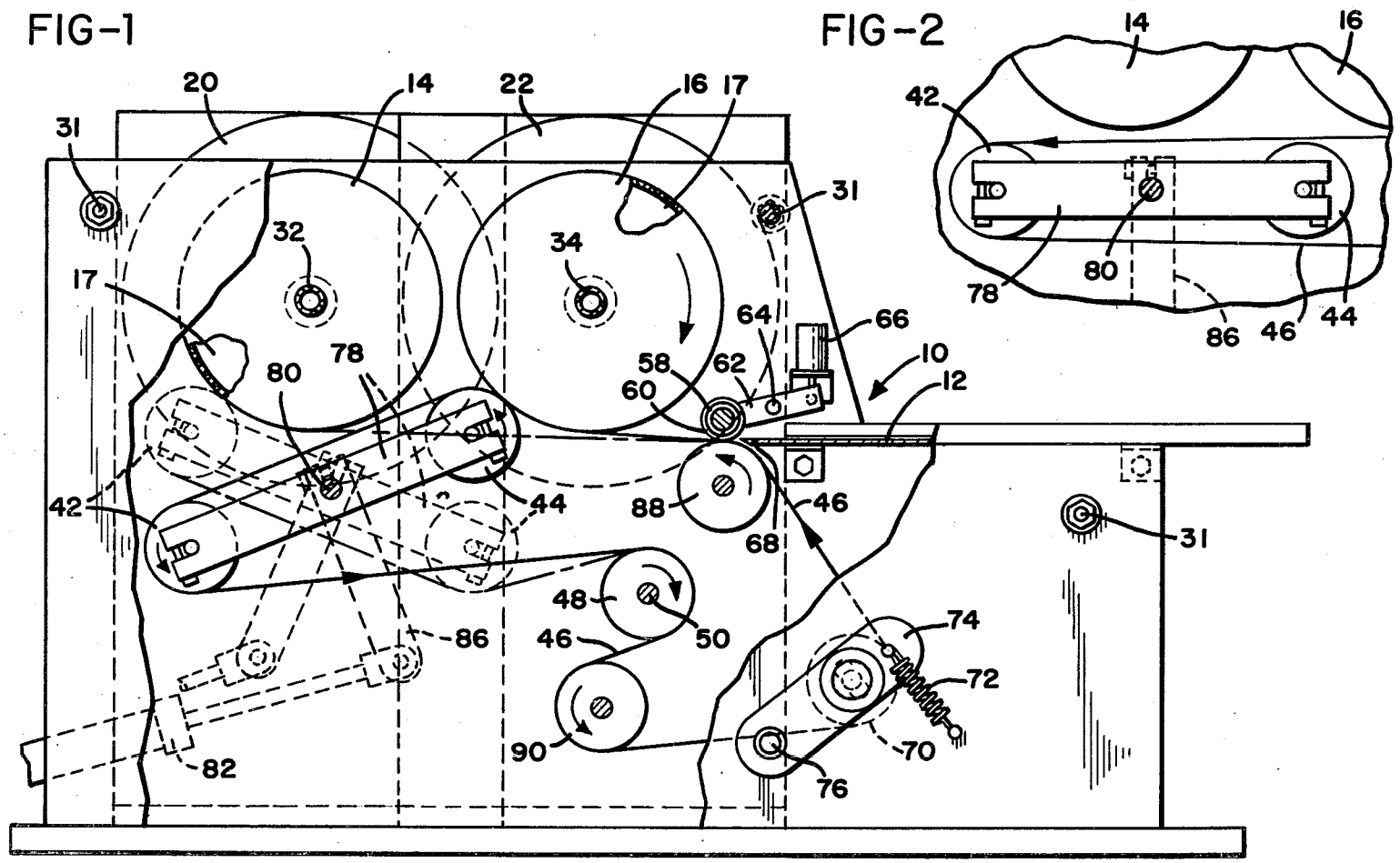
FIG. 1 is a side view of the sheet loading device of the present invention, with portions broken away and in section to reveal interior structure.
FIG. 2 is a partial view, similar to FIG. 1, showing the neutral position of the belt deflecting rollers.
Figure 3:
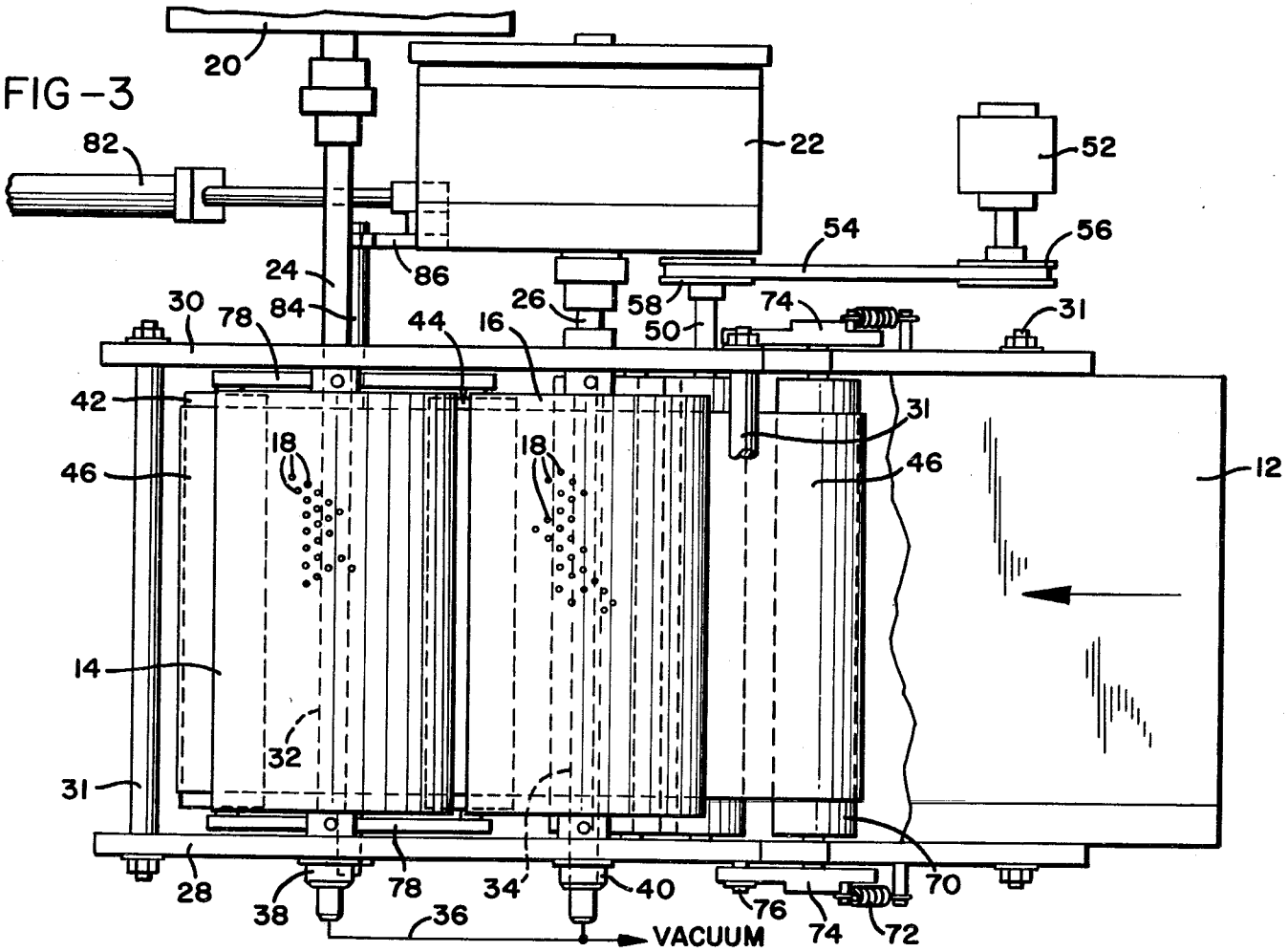
FIG. 3 is a plan view of the device of the present invention with portions of the device removed and broken away.

Reference is now made to FIG. 1 which is a plan view with portions broken away illustrating the sheet loading device of the present invention. The device will supply a sheet of material, such as paper, from a sheet supply station 10, including sheet support 12, to any of a plurality of sheet supporting rotatable drum means, including drums 14 and 16. Each of the drums 14 and 16 defines a drum cavity 17 and vacuum openings 18 (FIG. 3) in the exterior surface of the drum, which openings communicate with the drum cavity 17. Although only a few such openings are illustrated, it should be understood that openings 18 are spaced around the entire periphery of each of the drums. A suction means partially evacuates each of the drum cavities 17 to form a partial vacuum therein which tends to hold a sheet of paper on the exterior surface of the drum. Motors 20 and 22 are coupled to the drums 14 and 16, respectively, by shafts 24 and 26 and provide a means for rotating each of the paper supporting drum means about substantially parallel rotational axii. Each of the drums 14 and 16 is pivotally mounted between side frames 28 and 30, which side frames are held together by through bolts 31. Perforated tubes 32 and 34 extend into the drum cavities within drums 14 and 16 and communicate with vacuum line 36 via pivotal vacuum couplings 38 and 40, respectively.

A plurality of rotatably belt deflecting rollers, each of said rollers mounted adjacent a respective one of the plurality of sheet supporting drum means, includes rollers 42 and 44. An endless belt 46 passes between belt deflecting rollers 42 and 44 and the sheet supporting drums 14 and 16, as well as extending past the sheet supply station 10. A belt drive means for continuously moving the belt 46 past the rollers 42 and 44 and the sheet supply station 10 includes drive roller 48 which is pivotally mounted on side frames 28 and 30. The shaft 50 of roller 48 is connected to a belt drive motor 52 via timing belt 54 and pulleys 56 and 58. As motor 52 rotates, roller 48 will be rotated to drive belt 46 in the direction indicated.

A sheet supply means at the sheet supply station 10 urges a sheet of material into engagement with the belt 46 such that the sheet is carried by the belt 46 toward the drums 14 and 16. The sheet supply means may advantageously include a supply roller 58 having paper engaging rings 60 formed of an appropriate material such as rubber. Supply roller 58 is rotatably mounted on arms 62, which arms may be pivoted about pivot point 64, as shown in FIG. 1 by solenoid actuators 66. When supply roller 58 is moved downward the rings 60 will press a sheet of paper at the supply station 10 against the belt 46, thus causing the sheet to move with the belt 46 toward the drums 14 and 16. Until solenoid actuators 66 are energized, the sheet of paper will remain resting on paper support 12 with an edge of the sheet extending slightly beyond end 68 of the support 12. A sheet may be positioned at supply station 10 by any one of a number of sheet delivery systems.

As shown in FIG. 1, the belt 46 remains continuously in contact with the rollers 42 and 44 and is held in tension by a belt tensioning means including a belt tensioning roller 70. Roller 70 is biased against belt 46 by a spring means including spring 72 and roller mounting arms 74. Arms 74 are pivoted about pivot points 76.

A means for selectively translating the belt deflecting rollers 42 and 44 such that the belt is deflected to wrap around the respective paper supporting drum 14 and 16 includes roller supporting means comprising arms 78 which mount the rollers 42 and 44. Arms 78 are pivotally mounted to the side frames 28 and 30 by pivots 80 which are intermediate the rollers 42 and 44. A means for pivoting the roller supporting means about pivot point 80 includes pneumatic cylinder 82 which is connected to pivot shaft 84 by link 86.

As seen in FIG. 1, endless belt 46 is looped around rollers 42, 44, 48, and 70, and idler rollers 88 and 90. Belt 46 is deflected by roller 44 when the roller supporting means is pivoted in a first direction, indicated by the solid lines, such that the belt 46 is partially wrapped around the drum 16. When the roller supporting means is pivoted in a second direction, indicated by the dash lines, the belt 46 is deflected by roller 42 such that it partially wraps around the drum 14. The neutral position of the roller supporting means is illustrated in FIG. 2 in which the belt 46 is maintained out of contact with drums 14 and 16 by a predetermined minimum clearance.

Figure 4:
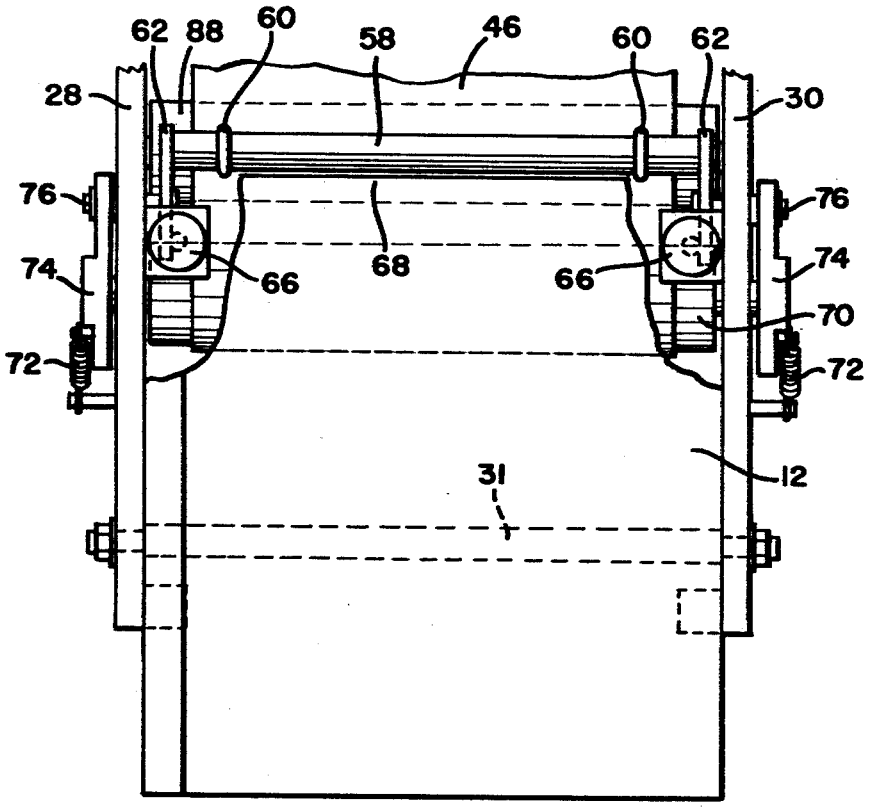
FIG. 4 is an enlarged partial plan view, similar to FIG. 3, but showing the sheet supply station and the sheet supply means of the device.

In operation, a sheet of paper will be positioned upon the support 12 at the paper supply station 10 with an edge of the sheet extending beyond the end 68 of the support 12. When the sheet is to be loaded onto one of the drums 14 and 16, solenoid 66 will be actuated to pivot arms 62 about pivot points 64, causing the rings 60, best seen in FIG. 4, to move downward and press the edge of the sheet against belt 46, backed by roller 88. The sheet will then move with the belt 46 toward the drums 14 and 16. Pneumatic cylinder 82 will be actuated into one of the positions illustrated in FIG. 1 from its neutral position, as shown in FIG. 2, such that the belt 46 is partially wrapped around the periphery of the selected drum upon which the sheet is to be positioned. As the sheet moves into contact with the selected drum, the suction provided through the openings 18 will hold the sheet on the exterior surface of the drum, thus completing the loading operation. The roller supporting means, including arms 78, is then pivoted back to the neutral position shown in FIG. 2. Further operations may thereafter be performed upon the sheet as it rotates upon the selected drum, such as printing upon the paper or scanning previously printed information.

During the loading operation, it is desirable that the belt 46 be moving at a speed substantially equal to the tangential velocity of the drum upon which the sheet is loaded. In some applications it may be desirable to thereafter accelerate the drum with the sheet mounted thereon to a higher rotational velocity prior to performing a printing or scanning operation.

It will be appreciated that the present invention is not limited to loading a sheet of paper onto only two drums but rather may be utilized to load sheets onto as many drums as may be desired. Where more than two drums are to be loaded, a number of pairs of belt deflecting rollers are positioned adjacent respective pairs of drums. The belt deflecting roller arrangement is such that a sheet may be loaded onto any of the drums by simply pivoting one of the pairs of belt deflecting rollers in the appropriate direction in order to provide a partial wrap of the belt around the selected drum.

While the method herein described and the form of apparatus for carrying this method into effect constitute preferred embodiments of the invention, it is to be understood that the invention is not limited to this precise method and form of apparatus, and that changes may be made in either without departing from the scope of the invention.

What is claimed is:

1. A sheet loading device for supplying a sheet of material from a sheet supply station to any of a plurality of sheet supporting rotatable drum means and positioning the sheet thereon, comprising:

a plurality of sheet supporting rotatable drum means for supporting a sheet on the exterior surfaces thereof, each of said drum means defining a drum cavity and vacuum openings in said exterior surface communicating with said drum cavity, suction means for partially evacuating each of the drum cavities to form a partial vacuum therein, means for rotating each of said plurality of sheet supporting drum means about substantially parallel rotational axii, a plurality of rotatable belt deflecting rollers, each of said rollers mounted adjacent a respective one of said plurality of sheet supporting drum means, an endless belt passing between said plurality of belt deflecting rollers and said plurality of sheet supporting drum means, said belt further extending past said sheet supply station, belt drive means for continuously moving said belt past said belt deflecting rollers and said sheet supply station, sheet supply means at said sheet supply station for urging a sheet into engagement with said belt such that said sheet is carried by said belt toward said plurality of sheet supporting drum means, and means for selectively translating any of said plurality of belt deflecting rollers toward its respective sheet supporting drum means and deflecting said belt to wrap partially around said respective sheet supporting drum means, whereby the sheet carried by said belt is loaded onto said respective sheet supporting drum means and held on said exterior surface thereof by the partial vacuum in said drum cavity of said respective drum means.

2. The sheet loading device of claim 1 in which said means for selectively translating any of said plurality of belt deflecting rollers comprises:

roller supporting means mounting a respective pair of said plurality of belt deflecting rollers, and means for pivoting said roller supporting means about a point intermediate said pair of belt deflecting rollers either in a first direction such that said belt is deflected by one of said pair of rollers to wrap partially around the drum means associated with said one of said pair of rollers or in a second direction such that said belt is deflected by the other of said pair of rollers to wrap partially around the drum means associated with said other of said pair of rollers, whereby pivoting of one of said roller supporting means in a desired direction results in a sheet being mounted upon a selected one of said plurality of sheet supporting drum means.

3. The sheet loading device of claim 1 in which said belt remains continuously in contact with said belt deflecting rollers and in which said device further comprises belt tensioning means for holding said belt in tension against said rollers.

4. The sheet loading device of claim 3 in which said belt tensioning means comprises a belt tensioning roller mounted within said belt in contact therewith, and spring means urging said belt tensioning roller against said belt thereby maintaining said belt in tension.

5. The sheet loading device of claim 1 in which said belt drive means drives said belt at a speed which is substantially equal to the tangential velocity of said drum means as a sheet is loaded thereon.

6. The sheet loading device of claim 1 in which said means for selectively translating any of said belt deflecting rollers maintains said belt out of contact with said drum means until a sheet is to be loaded thereon.

7. A sheet loading device for supplying a sheet of material from a sheet supply station to either of a pair of sheet supporting rotatable drum means and positioning the sheet thereon, comprising:

first and second sheet supporting drum means for supporting a sheet on the exterior surface thereof, each drum means defining a drum cavity and vacuum openings in said exterior surface communicating with said drum cavity, suction means for partially evacutating each of the drum cavities to form a partial vacuum therein, means for rotating said first and second sheet supporting drum means about substantially parallel rotational axii, a pair of belt deflecting rollers mounted by a roller supporting means adjacent said first and second sheet supporting drum means for rotation about parallel roller axii, said roller supporting means being pivotable about a pivot point intermediate said pair of belt deflecting rollers, an endless belt passing around said belt deflecting rollers adjacent said first and second sheet supporting drum means and further extending past said sheet supply station, belt drive means for continuously moving said belt around said belt deflecting rollers and past said sheet supply station, sheet supply means at said sheet supply station for engaging a sheet and urging said sheet against said belt such that said sheet is carried by said belt toward said first and second sheet supporting drum means, and means for selectively pivoting said roller supporting means in a first direction such that said belt is deflected to wrap partially around said first sheet supporting drum means and for selectively pivoting said roller supporting means in a second direction such that said belt is deflected to wrap partially around said second sheet supporting drum means, whereby a sheet carried by said belt is loaded onto the drum means around which said belt is partially wrapped and held on said exterior surface thereof by the partial vacuum in said drum cavity.

8. A method of transporting a sheet of material from a sheet supply station and selectively loading said sheet onto one of a plurality of drums which are rotating about substantially parallel rotational axii, comprising:

moving a sheet carrying belt from said sheet supply station past each of said drums, said belt positioned away from the exterior surface of each of said drums by a predetermined minimum clearance, engaging a sheet with said belt at said sheet supply station such that said sheet is carried by said belt, and deflecting said belt adjacent the point at which said belt moves past the drum onto which said sheet is to be loaded such that said belt contacts the exterior surface of the drum onto which said sheet is to be loaded, and wraps partially therearound whereby said sheet is carried by said belt into contact with the drum.

9. The method of claim 8 further comprising the step of evacuating a cavity in the drum upon which the sheet is to be loaded and communicating the reduced pressure in said cavity with the exterior surface of the drum whereby a sheet will be held on the exterior surface of said drum after contacting said surface.

10. The method of claim 8 in which the step of moving a sheet carrying belt comprises the step of moving said belt at a rate substantially equal to the tangential velocity of the drum onto which said sheet of copy paper is to be loaded.

11. A sheet loading device for supplying a sheet of material from a sheet supply station to any of a plurality of sheet supporting rotatable drum means and positioning the sheet thereon, comprising:

a plurality of sheet supporting rotatable drum means for supporting a sheet on the exterior surfaces thereof, means for rotating each of said plurality of sheet supporting drum means about substantially parallel rotational axii, an endless belt extending from said sheet supply station past each of said drum means, said belt positioned away from the exterior surface of each of said drum means by a predetermined minimum clearance, belt drive means for continuously moving said belt from said sheet supply station past said plurality of sheet supporting rotatable drum means, sheet supply means at said sheet supply station for urging a sheet into engagement with said belt such that the sheet is carried by said belt toward said plurality of sheet supporting drum means, and means for deflecting said belt adjacent the point at which said belt moves past the one of said plurality of sheet supporting rotatable drum means onto which said sheet is to be loaded such that said belt contacts the exterior surface of said one of said plurality of sheet supporting rotatable drum means and partially therearound, whereby said sheet is carried by said belt into contact with said drum means and is positioned thereon.

12. The sheet loading device of claim 11 in which each of said plurality of sheet supporting rotatable drum means comprises a rotatable drum defining a drum cavity and vacuum openings in the exterior surface of said drum communicating with said drum cavity, and in which said sheet loading device further comprises means for partially evacuating each of the drum cavities in said drums to form a partial vacuum therein.

13. The sheet loading device of claim 11 in which said means for rotating comprises means for rotating said one of said plurality of sheet supporting drum means onto which a sheet is to be loaded at a rate such that the tangential velocity of said drum means is substantially equal to the velocity of said belt moving past said drum means.

14. The sheet loading device of claim 11 in which said means for deflecting said belt comprise a plurality of belt deflecting rollers, each such roller associated with a respective one of said plurality of drum means, and means for selectively moving said plurality of belt deflecting rollers such that said belt is deflected to contact the exterior surface of the drum means onto which a sheet is to be loaded.

* * * * *

UNITED STATES PATENT AND TRADEMARK OFFICE

CERTIFICATE OF CORRECTION

PATENT NO. : 4,195,831

DATED : April 1, 1980

INVENTOR(S) : Richard Sutera

It is certified that error appears in the above-identified patent and that said Letters Patent are hereby corrected as shown below:

Column 6, line 26, "evacutating" should be --evacuating--.
Column 8, line 14, "wraps" should be inserted before "partially therearound".

Signed and Sealed this

Tenth Day of June 1980

[SEAL]

Attest:

SIDNEY A. DIAMOND

Attesting Officer

Commissioner of Patents and Trademarks